United States Patent [19]

Nigro

[11] Patent Number: 4,500,061

[45] Date of Patent: Feb. 19, 1985

[54] HOLDER

[75] Inventor: Louis V. Nigro, Saugus, Mass.

[73] Assignee: The Gillette Company, Boston, Mass.

[21] Appl. No.: 499,918

[22] Filed: Jun. 1, 1983

[51] Int. Cl.[3] ..... B65D 35/56

[52] U.S. Cl. ..... 248/359 I; 248/340; 222/105

[58] Field of Search ..... 248/359, 108, 359.1, 248/360, 359 I, 304, 339, 340; 24/514, 698, 241 SL, 238; 222/105

[56] References Cited

U.S. PATENT DOCUMENTS

| | | | |
|---|---|---|---|
| D. 248,135 | 6/1978 | Torongo | D6/87 |
| 1,243,140 | 10/1917 | Connolly | 222/100 |
| 1,668,246 | 5/1928 | Merchant | 211/30 |
| 2,021,609 | 11/1935 | Pippert | 24/563 |
| 2,161,516 | 6/1939 | Jung | 221/60 |
| 2,474,080 | 6/1949 | Witte | 248/108 |
| 2,519,987 | 8/1950 | Wernette | 24/563 |
| 2,662,745 | 12/1953 | Jorn et al. | 257/124 |
| 3,395,822 | 8/1968 | Donleavy | 222/105 |
| 3,446,468 | 5/1969 | Sakwa | 248/108 |
| 3,862,706 | 1/1975 | Burkart | 222/105 |

*Primary Examiner*—Ramon S. Britts
*Assistant Examiner*—Alvin Chin-Shue

[57] ABSTRACT

A holder is provided for a flexible tubular package of the type used for packaging a consumer product, such as shampoo, liquid soap, cream, lotion, food spread, or a lubricating product. The holder includes a coupling portion with two spaced sidewall portions. Flanges at the lower end of the sidewall portions are in spaced opposed alignment and define therebetween a slot for receiving the neck of the tubular package and the sidewall portions are spaced apart sufficiently to receive the base portion of the tubular package. A web that interconnects the sidewall portions intermediate their ends provides stabilizing support that tends to maintain the flanges in parallel alignment and permits pressure at one end of the sidewall portions that tends to close the slot at the one end to concurrently tend to open the slot at the other end. A support portion that is integral with and an upward extension of the sidewall portions permits the holder to be secured to a support member.

11 Claims, 3 Drawing Figures

Fig. 1
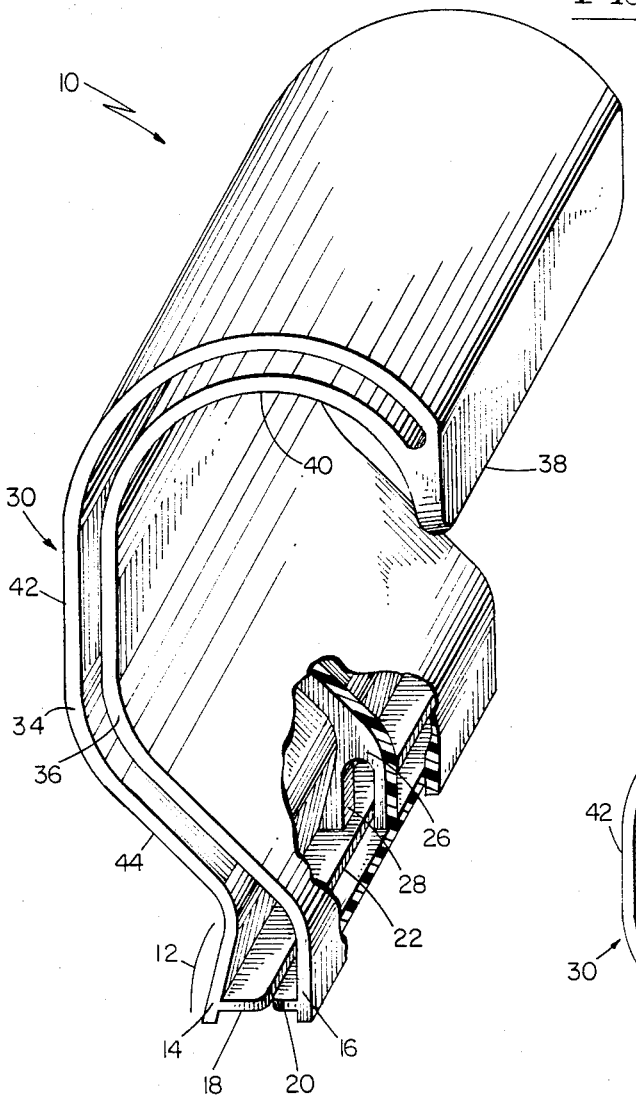
Fig. 3
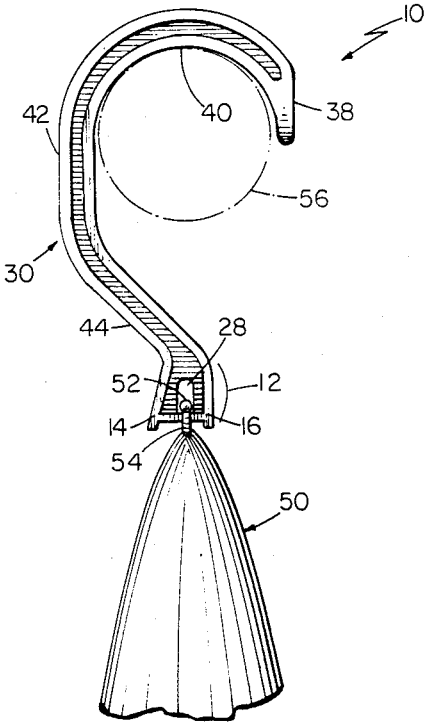
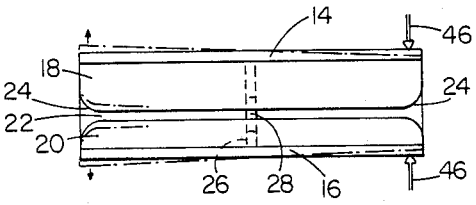
Fig. 2

HOLDER

This invention relates to holders for dispensing packages of the flexible tubular type.

The invention provides a holder which provides convenient and accessible storage for flexible tubular packages of the type which are used today for packaging a wide variety of consumer products, such as shampoos, liquid soaps, creams, lotions, food spreads, and lubricating products. Such packages typically have a somewhat enlarged transverse base portion and a holder in accordance with the invention includes a coupling portion with two spaced sidewall portions. Flanges at the lower end of the sidewall portions are in spaced opposed alignment and define therebetween a slot (that preferrably has a length that is at least ten times the width of the slot) for receiving the neck of the tubular package and the sidewall portions are spaced apart sufficiently to receive the base portion of the tubular package. A stabilizing web interconnects the sidewall portions intermediate their ends and stabilizes the dimensional configuration of the slot. Pressure at one end of the sidewall portions that tends to close the slot at the one end concurrently tends to open the slot at the other end. The base of the tubular package is attached to the coupling portion by sliding the neck portion of the package base into the slot, with one end of the slot optionally being opened as described above to facilitate that attachment. A support portion integral with and being an upward extension of the sidewall portions permits the holder to be secured to a hook or other suitable support member.

In a particular embodiment, the holder is a unitary holder of molded plastic material with the support portion including parallel sheet portions that are spaced about two millimeters apart and that extend substantially the entire length of the support portion. The stabilizing web extends continuously throughout the space between the sheet portions over substantially their entire length, and the support portion includes a cylindrical attachment section for engagement with a support rod or similar member, and an offset section which positions the coupling portion essentially directly beneath the center of the radius of the cylindrical attachment section. The flanges of the coupling portion are disposed in the same plane and the length of the slot defined by the flanges is over twenty times the width of the slot. The stabilizing web, which is located centrally between the ends of the sidewall and sheet portions, provides supplementary support for maintaining planar alignment of the flanges and has an opening adjacent the flanges for receiving an enlarged transverse base portion of the tubular package. Rounded corners of the flanges facilitate sliding introduction of the package neck into the slot.

The holder provides convenient support for a consumer product that is packaged in a flexible tubular package in a readily accessible location where the contents of the package may be dispensed as desired. For example, the package may remain supported on a rod or other appropriate support device during dispensing of the stored product from a spout at the end of the package opposite the base, or the holder-package assembly may be removed from the support for product dispensing and returned to the support after product dispensing for storage.

Other features and advantages of the invention will be seen as the following description of a particular embodiment progresses, in conjunction with the drawing, in which:

FIG. 1 is a perspective view (with parts broken away) of a holder in accordance with the invention;

FIG. 2 is a bottom view of the coupling portion of the holder shown in FIG. 1; and FIG. 3 is an end view of the holder shown in FIG. 1 attached to a tubular package and suspended from a support rod.

DESCRIPTION OF PARTICULAR EMBODIMENT

The holder 10 shown in FIG. 1 is a unitary member molded of polypropylene and includes a coupling section 12 that has two parallel side wall portions 14, 16, each of which has a thickness of about one millimeter and about 2.8 centimeters in transverse length. Sidewalls 14, 16 are spaced about nine millimeters apart at their lower ends, wall 14 being inclined at an angle of about fifteen degrees and wall 16 being vertically disposed. Extending inwardly towards one another from walls 14, 16 in opposed alignment are two integral flanges 18, 20 that define a slot 22 of about 0.8 millimeter width and about 2.8 centimeters length. The corners 24 of flanges 18, 20 are smoothly curved (radius of about $\frac{1}{4}$ centimeter) and define flared ends of slot 22, as indicated in FIG. 2. Disposed centrally between side walls 14, 16 is stabilizer web 26 that is about one millimeter in thickness and stabilizes the parallel position of flanges 18, 20 and the spaced structure of the side wall portions 14 and 16. Formed in the base of stabilizing web 26 is opening 28 that has a height of about $\frac{1}{2}$ centimeter and a width of about $\frac{1}{3}$ centimeter.

The upward extensions of the two sidewalls 14, 16 form a support portion 30 that includes parallel sheets 34, 36 that are connected at their upper ends at lip 38. Each sheet 34, 36 has a thickness of about one millimeter and a width of about 2.8 centimeters. Stabilizing web 26 continues centrally along the entire length of sheets 34, 36 to lip 38 and maintains the sheets spaced about two millimeters apart. Support portion 30 includes a cylindrical section 40 of about $1\frac{1}{4}$ centimeter radius, a vertical section 42 that is about one centimeter in length, and an offset section 44 that is inclined at about 45 degrees such that coupling section 12 is centered below cylindrical section 40.

The parallel sidewalls 14, 16 have a degree of angular movement as permitted by the flexible stabilizing web 26 so that opposed pressure on side walls 14, 16 at one end of coupling portion 12, as indicated by arrows 46 (FIG. 2) flexes the stabilizing web 26 and rotates the flanges 18, 20 (as indicated by dotted lines in FIG. 2) such that the width of slot 22 at the end of the flanges opposite from the point of applied pressure is widened. The transverse enlarged base of a tubular package is attached to the coupling portion by sliding the neck portion of the package base into the slot, with one end of the slot optionally being opened as described above to facilitate that attachment.

With reference to FIGS. 2 and 3, tubular package 50 is attached to holder 10 simply by slidingly introducing the enlarged base 52 of package 50 into the region above flanges 14, 16 with the neck 54 of the package disposed in slot 22 such that the enlarged transverse base 52 extends through the opening 28 in stabilizing web 26 as indicated in FIG. 3. If desired, the side walls 14, 16 may be grasped at one end as indicated by arrows 46 to widen slot 22 at the opposite end before the package neck 54 is introduced into slot 22. Tubular package 50 thus is securely attached to holder 10 with its neck 54 disposed in slot 22 and holder support portion 30 may be disposed on a rod 56 as indicated in FIG. 3, thus providing convenient storage for the tubular package 50 in a readily accessible location where the contents of the package may be dispensed as desired while the package 50 remains supported on rod 56, or the holder-package assembly may be removed from the support rod for product dispensing and then returned to the support rod 56 for storage after product dispensing.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. A unitary holder of molded plastic material for a tubular package that has a transverse base portion, said holder comprising a two spaced sidewall portions, a flange at the lower end of each said sidewall portion, said flanges being in spaced opposed alignment and defining therebetween a slot for receiving the neck of the tubular package and said sidewall portions spaced apart sufficiently to receive the base portion of the tubular package, and a stabilizing web interconnecting said sidewall portions intermediate their ends such that pressure at one end of said sidewall portions that tends to close said slot at said one end concurrently tends to open said slot at the other end, and a support portion integral with and being an upward extension of said sidewall portions for securing said holder to a support member.

2. The holder of claim 1 wherein said support portion includes spaced parallel sheet portions that extend substantially the entire length of said support portion.

3. The holder of claim 2 wherein said stabilizing web extends continuously through the space between said sheet portions over substantially their entire length.

4. The holder of claim 1 wherein said support portion is of shaped sheet configuration and includes a cylindrical attachment section for engagement with a support rod or similar member, said shaped sheet having a width greater than the radius of said cylindrical attachment section.

5. The holder of claim 4 wherein said support portion includes an offset section which positions said sidewall portions essentially directly beneath the center of the radius of said cylindrical attachment section.

6. The holder of claim 1 wherein said stabilizing web has an opening adjacent said flanges for receiving an enlarged transverse base portion of the tubular package.

7. The holder of claim 1 wherein said flanges of said sidewall portions are disposed in the same plane and the length of said slot defined by said flanges is at least ten times the width of said slot.

8. The holder of claim 7 wherein said flanges have rounded corners that define flared ends of said slot.

9. The holder of claim 8 wherein said stabilizing web is located centrally between the ends of said sidewall portions.

10. The holder of claim 9 wherein said support portion includes parallel sheet portions spaced about two millimeters apart that extend substantially the entire length of said support portion.

11. The holder of claim 10 wherein said support portion includes a cylindrical attachment section for engagement with a support rod or similar member and an offset section which positions said coupling portion essentially directly beneath the center of the radius of said cylindrical attachment section, said stabilizing web extends continuously throughout the space between said sheet portions over substantially their entire length and said stabilizing web has an opening adjacent said flanges for receiving an enlarged transverse base portion of the tubular package.

* * * * *